US009679755B2

(12) United States Patent
Tateishi et al.

(10) Patent No.: US 9,679,755 B2
(45) Date of Patent: Jun. 13, 2017

(54) IONIZATION APPARATUS

(71) Applicant: SHIMADZU CORPORATION, Kyoto-shi, Kyoto (JP)

(72) Inventors: Yusuke Tateishi, Kyoto (JP); Kazuteru Takahashi, Suita (JP); Hideki Sato, Kyoto (JP)

(73) Assignee: SHIMADZU CORPORATION, Kyoto-shi (JP)

( * ) Notice: Subject to any disclaimer, the term of this patent is extended or adjusted under 35 U.S.C. 154(b) by 0 days.

(21) Appl. No.: 15/049,366

(22) Filed: Feb. 22, 2016

(65) Prior Publication Data

US 2016/0247669 A1 Aug. 25, 2016

(30) Foreign Application Priority Data

Feb. 23, 2015 (JP) ..... 2015-032833

(51) Int. Cl.
*H01J 49/10* (2006.01)
*H01J 49/14* (2006.01)

(52) U.S. Cl.
CPC ..... *H01J 49/147* (2013.01)

(58) Field of Classification Search
USPC ..... 250/288, 423 R, 423 F, 424, 427; 315/111.01, 111.81, 111.91
See application file for complete search history.

(56) References Cited

U.S. PATENT DOCUMENTS

2005/0017167 A1* 1/2005 Franzen ..... H01J 49/4225 250/288
2015/0200083 A1* 7/2015 Brown ..... H01J 49/049 250/282

(Continued)

FOREIGN PATENT DOCUMENTS

CN 104254903 A 12/2014
JP 2005-259482 A 9/2005

(Continued)

OTHER PUBLICATIONS

Communication dated Jul. 22, 2016, from the European Patent Office in counterpart European Application No. 16156663.3.

(Continued)

*Primary Examiner* — Nicole Ippolito
(74) *Attorney, Agent, or Firm* — Sughrue Mion, PLLC

(57) ABSTRACT

In an ion source 3 in which a repeller electrode 32 for forming a repelling electric field that repels ions toward an ion emission port 311 is provided inside of an ionization chamber 31, ion focusing electrodes 36 and 37 are respectively arranged between an electron introduction port 312 and a filament 34 and between an electron discharge port 313 and a counter filament 35. An electric field formed by applying a predetermined voltage to each of the ion focusing electrodes 36 and 37 intrudes into the ionization chamber 31 through the electron introduction port 312 and the electron discharge port 313, and becomes a focusing electric field that pushes the ions in an ion optical axis C direction. Ions at positions off a central part of the ionization chamber 31 receive the combined force of the force of the repelling electric field and the force of the focusing electric field, and move toward the ion emission port 311 while approaching the ion optical axis C. Accordingly, the amount of ions sent out from the ion emission port increases. Further, even if a charge-up phenomenon occurs, the ion trajectories less easily change, and the stability of the sensitivity can be enhanced.

4 Claims, 5 Drawing Sheets

(56) References Cited

U.S. PATENT DOCUMENTS

| | | | | |
|---|---|---|---|---|
| 2016/0086759 | A1* | 3/2016 | Horsky | H01J 27/205 315/111.21 |
| 2016/0126078 | A1* | 5/2016 | Liepert | H01J 49/10 250/282 |
| 2016/0155624 | A1* | 6/2016 | Verenchikov | H01J 49/406 250/283 |

FOREIGN PATENT DOCUMENTS

| | | | |
|---|---|---|---|
| WO | 2013163530 | A2 | 10/2013 |
| WO | 2015153644 | A1 | 10/2015 |

OTHER PUBLICATIONS

Communication dated Apr. 13, 2017 from the State Intellectual Property Office of the People's Republic of China in application No. 201610099211.4.

* cited by examiner

REPELLER ELECTRODE IS USED WITH CHARGE-UP

REPELLER ELECTRODE IS USED WITHOUT CHARGE-UP

EXTRACTION ELECTRODE IS USED WITHOUT CHARGE-UP

EXTRACTION ELECTRODE IS USED WITH CHARGE-UP

PRESENT INVENTION
WITHOUT CHARGE-UP

PRESENT INVENTION
WITH CHARGE-UP

IONIZATION APPARATUS

TECHNICAL FIELD

The present invention relates to an ionization apparatus for ionizing sample molecules and atoms, and, more specifically, relates to an ionization apparatus using thermal electrons according to an electron ionization (EI) method, a chemical ionization (CI) method, and other such methods. The ionization apparatus according to the present invention can be used as, for example, an ion source of a mass spectrometer, and can also be used for various apparatuses using ions such as an ion implantation apparatus.

BACKGROUND ART

When a gas sample is ionized in a mass spectrometer, an ionization method using thermal electrons, such as an electron ionization method and a chemical ionization method, is generally used. FIG. 6 and FIG. 7 are configuration diagrams of conventional general EI ion sources. Although an example case where positive ions are analyzed is described here, even in the case where negative ions are to be analyzed, a basic operation is the same except that the polarities of voltages are reversed.

A box-like ionization chamber 31 installed inside of a vacuum chamber (not illustrated) maintained at high vacuum has, formed therein: a sample introduction port 314 through which a sample gas is supplied; an ion emission port 311 from which ions are emitted; an electron introduction port 312 through which thermal electrons are introduced; and an electron discharge port 313 from which the thermal electrons are discharged. A filament 34 housed in a filament chamber 341 is arranged on the outer side of the electron introduction port 312. When a heating current If is supplied to the filament 34 from a heating current source (not illustrated), the temperature of the filament 34 rises, and thermal electrons are emitted from the surface of the filament 34. Meanwhile, a counter filament 35 housed in a filament chamber 351 is arranged as a trap electrode on the outer side of the electron discharge port 313. A voltage V1 of, for example, −70 [V] is applied to the filament 34. A voltage V2 of, for example, −71 [V], which is slightly lower than the voltage V1, is applied to the filament chamber 341. A positive voltage V4 of, for example, approximately +10 [V] is applied to the counter filament 35. Moreover, the ionization chamber 31 has a ground potential (0 [V]).

The thermal electrons produced from the filament 34 are accelerated by a potential difference (−71 [V]→0 [V]) between the filament chamber 341 and the ionization chamber 31, and are introduced into the ionization chamber 31 through the electron introduction port 312. The sample gas is introduced into the ionization chamber 31 from the sample introduction port 314. When a sample molecule M and a thermal electron $e^-$ contact each other in the ionization chamber 31, an electron emission of $M+e^- \rightarrow M^+ + 2e^-$ occurs. Consequently, a sample molecular ion or a sample atomic ion is produced. The electrons are attracted by the positive voltage V4 applied to the counter filament 35 to reach the counter filament 35, and a trap current Ib flows in the counter filament 35. The number of electrons trapped by the counter filament 35 depends on the number of electrons emitted from the filament 34. Hence, for example, a control circuit (not illustrated) controls the heating current If such that the trap current Ib has a predetermined value. This makes the amount of thermal electrons produced from the filament 34 substantially constant, so that stable ionization is achieved in the ionization chamber 31.

A pair of magnets 38 are installed on the outer sides of the filament 34 and the counter filament 35, and the pair of magnets 38 form a magnetic field inside and around the ionization chamber 31. Due to this magnetic field, the thermal electrons produced from the filament 34 and passing through the inside of the ionization chamber 31 toward the counter filament 35 fly on spirally whirling trajectories. Consequently, compared with the case where the electrons simply linearly fly, chances of contact between the electrons and the sample molecules increase, whereby the ionization efficiency can be enhanced.

In both the configurations illustrated in FIG. 6 and FIG. 7, sample-derived ions are produced in the ionization chamber 31 in such a manner as described above. The sample-derived ions thus produced are emitted to the outside of the ionization chamber 31 through the ion emission port 311 to be used for mass spectrometry. A mechanism for the ion emission is different between FIG. 6 and FIG. 7.

In the ion source illustrated in FIG. 6, a negative DC voltage V5 is applied to an extraction electrode 41 arranged on the outer side of the ion emission port 311. An electric field formed by a potential difference between the extraction electrode 41 and the ionization chamber 31 intrudes into the ionization chamber 31 through the ion emission port 311. Due to an action of this electric field, the ions produced in the ionization chamber 31 are extracted rightward in FIG. 6 (this operation is hereinafter referred to as an "extracting mode"), and are sent to a mass analyzer (not illustrated) such as a quadrupole mass filter.

In the ion source illustrated in FIG. 7, a repeller electrode 32 is arranged inside of the ionization chamber 31 and at a position opposed to the ion emission port 311, and a positive DC voltage V6 is applied to the repeller electrode 32. Due to an action of an electric field thus formed, the ions produced in the ionization chamber 31 are repelled rightward in FIG. 7 (this operation is hereinafter referred to as a "repelling mode"), are caused to pass through the ion emission port 311, and are sent to a mass analyzer (not illustrated). In some cases, both the ion repelling action of the repeller electrode 32 and the ion extracting action of the extraction electrode 41 are used.

In order to achieve high analysis sensitivity in the mass spectrometer, it is desirable to lead ions that are to be analyzed among the ions produced in the ionization chamber 31 to the mass analyzer with as low a loss as possible. Moreover, in order to maintain the reliability of a calibration curve used for quantitative determination, it is desirable that a decrease (change) in detection sensitivity when the apparatus is continuously used be as small as possible, that is, the stability of the sensitivity be high. However, as described below, it is difficult to achieve both high sensitivity and the stability of the sensitivity in the conventional ionization apparatuses.

In the case of the ion source adopting the repelling mode illustrated in FIG. 7, because the ions are repelled by the electric field formed by the voltage applied to the repeller electrode 32 arranged at a position away from the ion emission port 311, the potential gradient becomes gentler toward the ion emission port 311. Hence, ions produced in a region around a central part of the ionization chamber 31 receive sufficient energy to move toward the ion emission port 311 and are sent out from the ion emission port 311, whereas ions produced around the corners on the ion emission port 311 side in the ionization chamber 31 less easily pass through the ion emission port 311 and most of the ions disappear upon contacting a wall surface of the ionization chamber 31 around the ion emission port 311. Moreover, ions produced near the electron introduction port 312 and the electron discharge port 313 easily flow out through the electron introduction port 312 and the electron discharge port 313. As a result, in the repelling mode, only the ions produced in a relatively narrow region around the center of the ionization chamber 31 can be mainly used for mass spectrometry, and it is difficult to achieve high analysis sensitivity.

In the case of the ion source adopting the extracting mode illustrated in FIG. 6, the electric field that is formed outside of the ionization chamber 31 by the voltage applied to the extraction electrode 41 intrudes into the ionization chamber 31 through the ion emission port 311, and the ions are extracted by the extracting electric field thus formed. The extracting electric field that intrudes through the ion emission port 311 reaches even a region around the center of the ionization chamber 31, and hence the ions produced around the center of the ionization chamber 31 are favorably extracted from the ionization chamber 31. Moreover, the electric field around the ion emission port 311 near the extraction electrode 41 is strong, and hence, compared with the repelling mode described above, a larger amount of the ions produced around the corners on the ion emission port 311 side in the ionization chamber 31 can be extracted. Accordingly, compared with the repelling mode, the extracting mode can more efficiently send out the ions produced in the ionization chamber 31 from the ion emission port 311, and is more advantageous to enhancement of the analysis sensitivity.

Even in the extracting mode, the extracting electric field less easily reaches a region around the electron introduction port 312 and a region around the electron discharge port 313 in the ionization chamber 31, and hence the ions produced around these ports may flow out through the electron introduction port 312 and the electron discharge port 313. To solve this, in an ionization apparatus described in Patent Literature 1, ion leakage preventing electrodes each including an opening that allows passing of electrons are respectively arranged between the filament 34 and the electron introduction port 312 and between the electron discharge port 313 and the counter filament 35, and a predetermined voltage is applied to each ion leakage preventing electrode such that an electric field whose gradient becomes steeper for the ions from each of the electron introduction port 312 and the electron discharge port 313 toward the ion leakage preventing electrode is formed. Consequently, the ions that are about to flow to the outside from the electron introduction port 312 and the electron discharge port 313 are returned to the inside of the ionization chamber 31, whereby an ion loss can be suppressed. Hence, the ionization apparatus described in Patent Literature 1 is further advantageous to enhancement of the analysis sensitivity.

As described above, the extracting mode is more advantageous than the repelling mode in terms of achieving high sensitivity. However, according to studies made by the inventor of the present application, the extracting mode is more disadvantageous than the repelling mode in terms of achieving the stability of the sensitivity.

Specifically, as described above, in the extracting mode, the potential gradient for moving the ions is given by the intrusion of the electric field formed by the voltage applied to the extraction electrode 41 arranged outside of the ionization chamber 31, and hence the potential gradient around the center of the ionization chamber 31 is gentler than that of the electric field that is formed in the ionization chamber 31 in the repelling mode. Along with long-term use of the apparatus, a charge-up phenomenon may occur in the ionization chamber 31, which is made of a conductor, so that the state of the electric field formed in the ionization chamber 31 changes. As the potential gradient in the ionization chamber 31 is gentler, influences of such a change in electric field due to, so to speak, disturbance are larger. Hence, even if the analysis sensitivity of the extracting mode is initially higher than that of the repelling mode, a charge-up phenomenon associated with long-term use of the apparatus prevents the ions from being extracted along appropriate trajectories, so that the amount of ions that reach the mass analyzer significantly decreases, and the analysis sensitivity of the extracting mode becomes lower than that of the repelling mode.

CITATION LIST

Patent Literature

[Patent Literature 1] JP 2005-259482 A

SUMMARY OF INVENTION

Technical Problem

As described above, comparing the extracting mode and the repelling mode with each other, the former is more advantageous in terms of high sensitivity but inferior in terms of stable sensitivity, whereas the latter is superior in terms of stable sensitivity but has relatively low sensitivity. In other words, from the perspectives of high sensitivity and the stability of the sensitivity, the extracting mode and the repelling mode have advantages and disadvantages, and it is difficult to stably maintain high sensitivity. This also applies to the combination use of the extracting mode and the repelling mode. This is because optimal values of the voltage applied to the repeller electrode 32 and the voltage applied to the extraction electrode 41 are not the same between when high sensitivity is achieved and when the stability of the sensitivity is achieved.

An object of the present invention, which has been made in order to solve the above-mentioned problems, is to provide an ionization apparatus capable of sending out ions produced in an ionization chamber to the subsequent stage with as low a loss as possible, minimizing influences of a charge-up phenomenon that occurs along with long-term use of the apparatus, and thus achieving both high analysis sensitivity and high stability of the sensitivity.

Solution to Problem

In order to achieve the above-mentioned object, the present invention provides an ionization apparatus for ionizing predetermined sample molecules or atoms, the ionization apparatus including:

a) an ionization chamber having: an electron introduction port for introducing thermal electrons to an internal space of the ionization chamber; an electron discharge port for discharging thermal electrons that have passed through the internal space; and an ion emission port for emitting sample-derived ions produced in the internal space to an outside;

b) a thermal electron source for producing the thermal electrons, the thermal electron source being arranged on an outer side of the electron introduction port;

c) an electron trapping unit for trapping the thermal electrons discharged through the electron discharge port, the electron trapping unit being arranged on an outer side of the electron discharge port;

d) a repeller electrode for forming, in the ionization chamber, a repelling electric field that repels the sample-derived ions produced in the ionization chamber toward the ion emission port, the repeller electrode being arranged inside of the ionization chamber so as to be opposed to the ion emission port; and e) an ion focusing electrode for forming, in the ionization chamber, a focusing electric field that focuses the sample-derived ions produced in the ionization chamber around a central axis of an ion flow formed by repelling the sample-derived ions by the repelling electric field, the ion focusing electrode being arranged any one or both of between the thermal electron source and the electron introduction port and between the electron discharge port and the electron trapping unit.

In the ionization apparatus according to the present invention, sample molecules or atoms in a sample gas introduced into the ionization chamber contact thermal electrons, or the sample molecules or atoms react chemically with buffer ions produced by contact between a buffer gas contained in the sample gas or a separately supplied buffer gas and the thermal electrons, whereby the sample molecules or atoms are ionized. The sample-derived ions thus produced in the ionization chamber move toward the ion emission port due to an action of the repelling electric field that is formed in the ionization chamber by applying a predetermined voltage to the repeller electrode that is arranged inside of the ionization chamber so as to be opposed to the ion emission port. In other words, in the ionization apparatus according to the present invention, the sample-derived ions are sent out from the ion emission port in the repelling mode.

In the ionization apparatus according to the present invention, in addition to the force of the repelling electric field acting on the ions, the focusing electric field formed by applying a predetermined voltage to the ion focusing electrode arranged outside of the ionization chamber intrudes into the ionization chamber through the electron introduction port and/or the electron discharge port, and the focusing electric field gives a force to the ions such that the ions diffusing in directions toward the electron introduction port and the electron discharge port are focused toward a central part of the ionization chamber. Typically, the ion emission port is provided such that the ions are emitted in a direction substantially orthogonal to a direction in which the thermal electrons are introduced into the ionization chamber through the electron introduction port. In this case, the direction in which the focusing electric field pushes the ions in the ionization chamber is a direction substantially orthogonal to the direction in which the repelling electric field repels the ions. Hence, the combined force of the force of the repelling electric field and the force of the focusing electric field is given to the ions at positions relatively close to the electron introduction port and the electron discharge port in the ionization chamber. Consequently, the ions move so as to be focused around the central axis of the ion flow while travelling toward the ion emission port. As a result, the ions that will otherwise contact a wall or the like of the ionization chamber around the ion emission port and disappear in the state where only the repelling electric field acts on the ions can more easily pass through the ion emission port, so that a larger amount of ions can be sent to the subsequent stage.

In the ionization apparatus according to the present invention, the ions are sent out from the ion emission port using the repelling electric field which is less easily influenced by disturbance such as a charge-up phenomenon, and further the potential gradient of the focusing electric field that intrudes into the ionization chamber through the electron introduction port and the electron discharge port is also less easily influenced by the charge-up phenomenon around the ion emission port. Hence, even in the case where the charge-up phenomenon occurs, the trajectories of the sample-derived ions less easily change when the ions are sent out through the ion emission port, so that an ion low-loss state can be maintained. For these reasons, with the ionization apparatus according to the present invention used as an ion source of a mass spectrometer, high analysis sensitivity can be achieved, and such high analysis sensitivity can be maintained even in long-term use of the apparatus.

According to studies made by the inventor of the present application, in order to achieve high analysis sensitivity and high stability of the sensitivity as described above, the ionization apparatus according to the present invention may further include a voltage applying unit for applying a DC voltage Vr having the same polarity as that of the sample-derived ions, to the repeller electrode and for applying a DC voltage Vs having the same polarity as that of the sample-derived ions, to the ion focusing electrode, the DC voltage Vr may be between 1 and 20 [V] and more preferably 1 and 8 [V], and the DC voltage Vs may be between 5 and 50 [V] and more preferably 5 and 20 [V]. Appropriate values for the applied voltages may be determined in accordance with the sizes and distances of the ionization chamber and other components.

Advantageous Effects of Invention

In the ionization apparatus according to the present invention, with the use of both the ion repelling action of the repeller electrode arranged inside of the ionization chamber and the ion focusing action of the ion focusing electrode arranged outside of the ionization chamber, the ions produced in the ionization chamber are led to the ion emission port, and are sent out to the subsequent stage through the ion emission port. Consequently, an ion loss can be suppressed compared with an ionization apparatus using the conventional repelling mode, and a larger amount of ions can be sent out from the ion emission port. In addition, even if the charge-up phenomenon occurs along with long-term use of the apparatus, a change in ion trajectories can be reduced. As a result, with the ionization apparatus according to the present invention used as an ion source of a mass spectrometer, the amount of ions to be used for mass spectrometry increases, enhancement of the analysis sensitivity can be achieved, and such high sensitivity can be maintained over a long period.

BRIEF DESCRIPTION OF DRAWINGS

FIG. 3A and FIG. 3B are diagrams each illustrating a simulation result of ion trajectories at the time of using a repeller electrode (repelling mode) in a conventional ion source, in which FIG. 3A illustrates the case without charge-up and FIG. 3B illustrates the case with charge-up.

FIG. 4A and FIG. 4B are diagrams each illustrating a simulation result of ion trajectories at the time of using an extraction electrode (extracting mode) in a conventional ion source, in which FIG. 4A illustrates the case without charge-up and FIG. 4B illustrates the case with charge-up.

FIG. 5A and FIG. 5B are diagrams each illustrating a simulation result of ion trajectories in an ion source according to the present invention, in which FIG. 5A illustrates the case without charge-up and FIG. 5B illustrates the case with charge-up.

DESCRIPTION OF EMBODIMENTS

Figure 1:
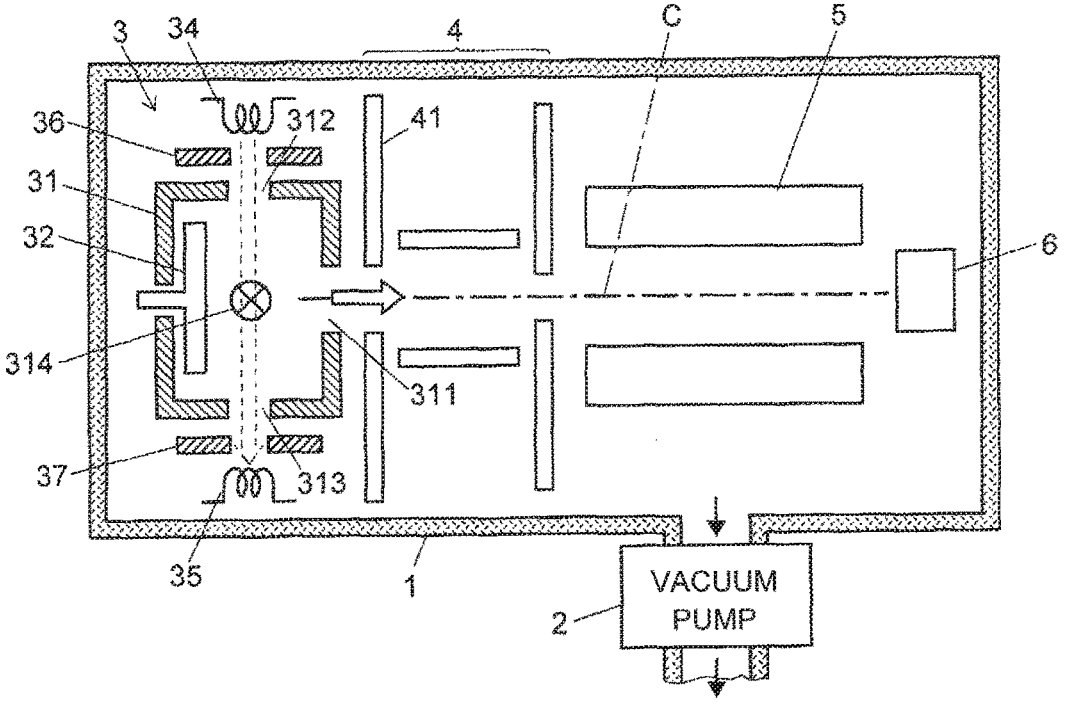
FIG. 1 is a schematic configuration diagram of a mass spectrometer using an ion source according to an embodiment of the present invention.
Figure 2:
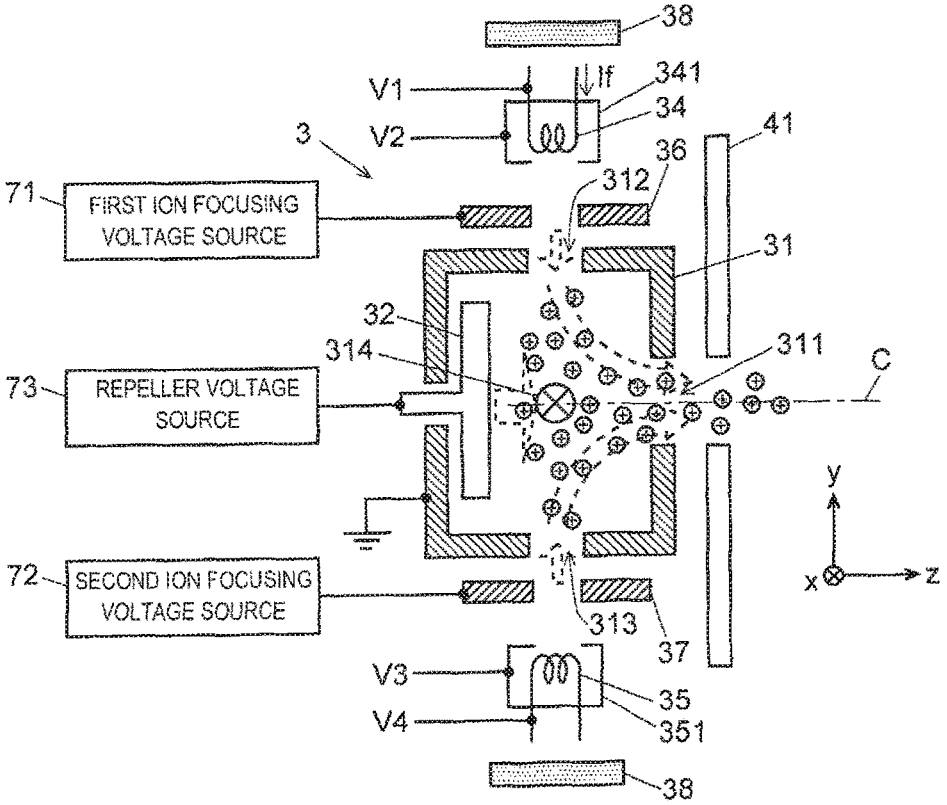
FIG. 2 is a configuration diagram of the ion source according to the present embodiment.
Figure 6:
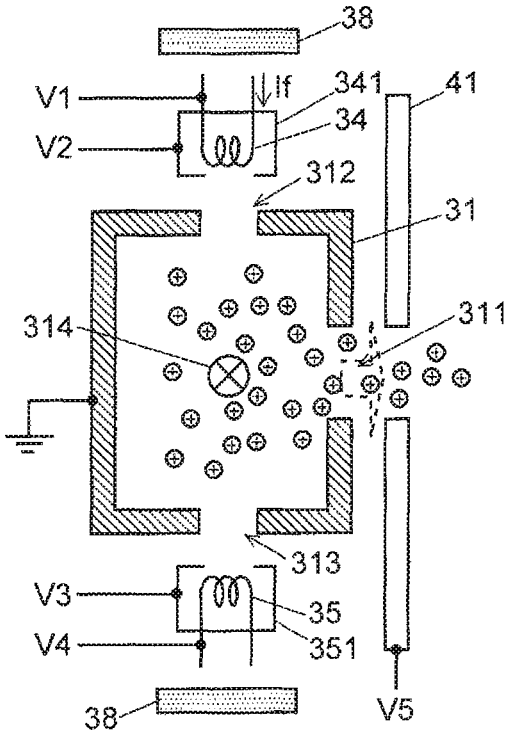
FIG. 6 is a configuration diagram of the conventional ion source (repelling mode).

An ion source according to an embodiment of the present invention is described with reference to the attached drawings. FIG. 1 is a schematic configuration diagram of a mass spectrometer using the ion source according to the present embodiment, and FIG. 2 is a configuration diagram of the ion source according to the present embodiment. The same constituent elements as those in the conventional ion sources that have already been described with reference to FIG. 6 and FIG. 7 are denoted by the same reference signs.

First, the mass spectrometer using the ion source of the present embodiment is described with reference to FIG. 1. An ion source 3, an ion transport optical system 4, a quadrupole mass filter 5 as a mass analyzer, and an ion detector 6 are arranged inside of a chamber 1 that is evacuated by a vacuum pump 2. For example, a sample gas that flows out from a column of a gas chromatograph (not illustrated) is communicated with a sample introduction port 314 of an ionization chamber 31, and sample molecules or atoms contained in the sample gas continuously supplied to the ionization chamber 31 are ionized upon contacting thermal electrons produced from a filament 34. As described later, the sample-derived ions thus produced are sent out from the ionization chamber 31 through an ion emission port 311, are focused by the ion transport optical system 4, and are introduced to a space in the long axis direction of the quadrupole mass filter 5. A voltage in which a DC voltage and an RF voltage are superposed is applied to the quadrupole mass filter 5 from a power source (not illustrated), and only ions having a mass-to-charge ratio m/z corresponding to the applied voltage pass through the space in the long axis direction and reach the ion detector 6 to be detected by the ion detector 6. The other unnecessary ionic species cannot pass through the space in the long axis direction of the quadrupole mass filter 5, and thus diverge and disappear on the way.

Figure 7:
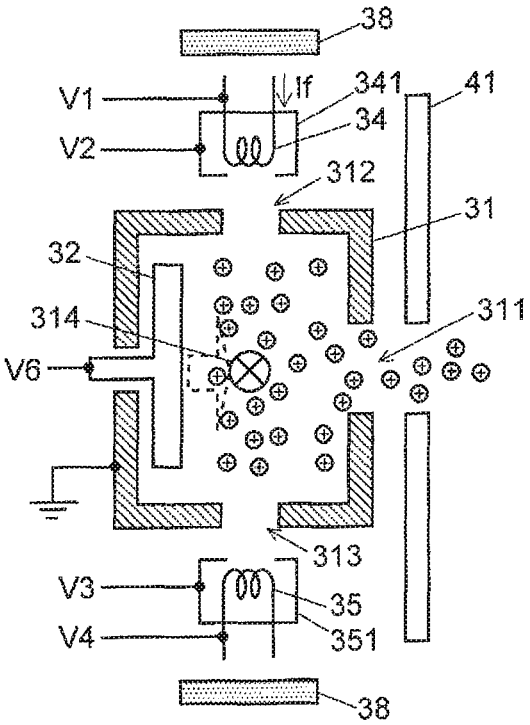
FIG. 7 is a configuration diagram of the conventional ion source (extracting mode).

As illustrated in FIG. 1 and FIG. 2, in the ion source 3 of the present embodiment, similarly to the conventional ion source illustrated in FIG. 7, a repeller electrode 32 is arranged at a position opposed to the ion emission port 311 in the ionization chamber 31, and a predetermined DC voltage is applied to the repeller electrode 32 from a repeller voltage source 73. Ion focusing electrodes 36 and 37 are respectively arranged between an electron introduction port 312 and a filament chamber 341 and between an electron discharge port 313 and a filament chamber 351. Each of the ion focusing electrodes 36 and 37 is, for example, a ring-like conductor including an electron pass opening having an inner diameter that is substantially the same as or slightly smaller than the inner diameter of each of the electron introduction port 312 and the electron discharge port 313. A predetermined DC voltage is applied to the ion focusing electrode 36 from a first ion focusing voltage source 71, and a predetermined DC voltage is applied to the ion focusing electrode 37 from another second ion focusing voltage source 72. In other words, independent voltages can be respectively applied to the two ion focusing electrodes 36 and 37.

In the case where positive ions are to be analyzed, the repeller voltage source 73 applies a DC voltage of Vr=1 and 20 [V] to the repeller electrode 32. The first and second ion focusing voltage sources 71 and 72 respectively apply a DC voltage of Vs=5 and 50 [V] to the ion focusing electrodes 36 and 37. The applied voltages Vr and Vs are different depending on the size of the ionization chamber 31, the sizes of the electron introduction port 312 and the electron discharge port 313, the shapes of the ion focusing electrodes 36 and 37, distances from the electron introduction port 312 and the electron discharge port 313, and other factors. For example, appropriate values for the applied voltages Vr and Vs may be determined in advance based on simulations and experiments.

The thermal electrons produced from the filament 34 enter the inside of the ionization chamber 31 through the electron introduction port 312, and move toward the electron discharge port 313 while each flying on a spiral trajectory due to an action of a magnetic field formed by a pair of magnets 38. When the thermal electrons contact sample molecules or atoms on the way, the sample molecules or atoms are ionized. The ionization chamber 31 is grounded, and the positive DC voltage Vr of approximately 1 and 20 [V] is applied to the repeller electrode 32 as described above. Hence, a repelling electric field having a force of repelling the ions in the z-axis positive direction (rightward in FIG. 2) from the repeller electrode 32 toward the ion emission port 311 is formed in the ionization chamber 31. This is similar to the conventional ion source illustrated in FIG. 7.

The thermal electrons each having a negative charge exist in an elongated region in the y-axis direction in the ionization chamber 31. Due to a space-charge effect produced by the electrons, the sample-derived ions each having the polarity opposite to that of the electrons tend to spread in the y-axis direction. To deal with this, in the ion source 3 of the present embodiment, the positive DC voltage Vs of approximately 5 and 50 [V] is applied to the ion focusing electrodes 36 and 37 respectively closely arranged on the outer sides of the electron introduction port 312 and the electron discharge port 313 as described above. Hence, an electric field is formed by a potential difference between the ion focusing electrodes 36 and 37 and the ionization chamber 31, and the electric field intrudes into the ionization chamber 31 through the electron introduction port 312 and the electron discharge port 313. This focusing electric field acts to push the ions in the y-axis negative direction (downward in FIG. 2) around the electron introduction port 312, and acts to push the ions in the y-axis positive direction (upward in FIG. 2) around the electron discharge port 313. Namely, this focusing electric field acts to confine the ions spreading in the y-axis positive-negative direction to a central part of the ionization chamber 31.

In actuality, because the combined force of the repelling force of the repelling electric field and the confining (focusing) force of the focusing electric field acts on the ions, the ions existing around the center of the ionization chamber 31 are pushed in the z-axis positive direction, and the ions existing at positions closer to the electron introduction port 312 and the electron discharge port 313 than the ions existing around the center are pushed toward the ion emission port 311 while approaching an ion optical axis C as the central axis of the ion flow. Hence, collisions of ions against a wall surface of the ionization chamber 31 around the ion emission port 311 as in the simple repelling mode can be avoided, and these ions can be sent out from the ion emission port 311. In other words, the amount of ions that can be sent out from the ion emission port 311, in other words, can be used for mass spectrometry is larger than that in the conventional repelling mode, and this leads to enhancement of the analysis sensitivity.

Figure 3B:
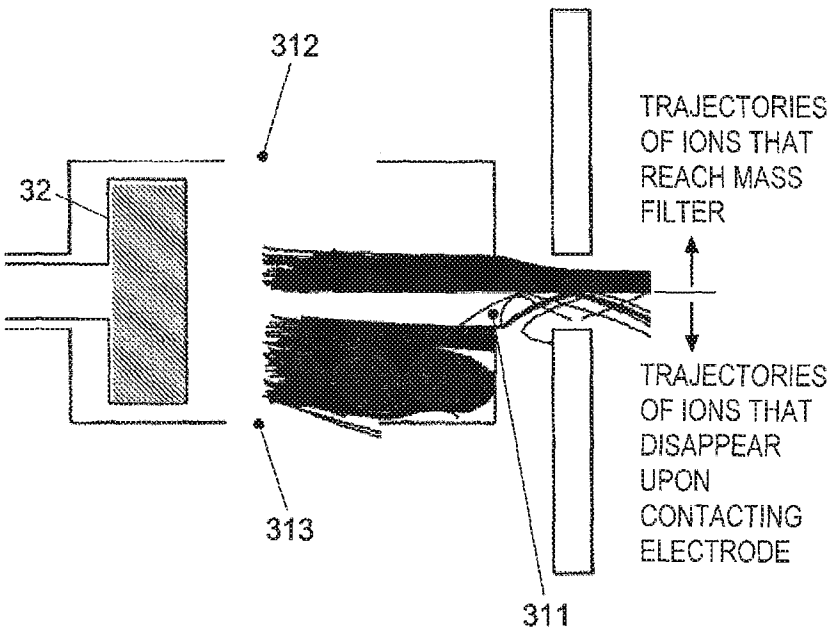
Figure 3A:
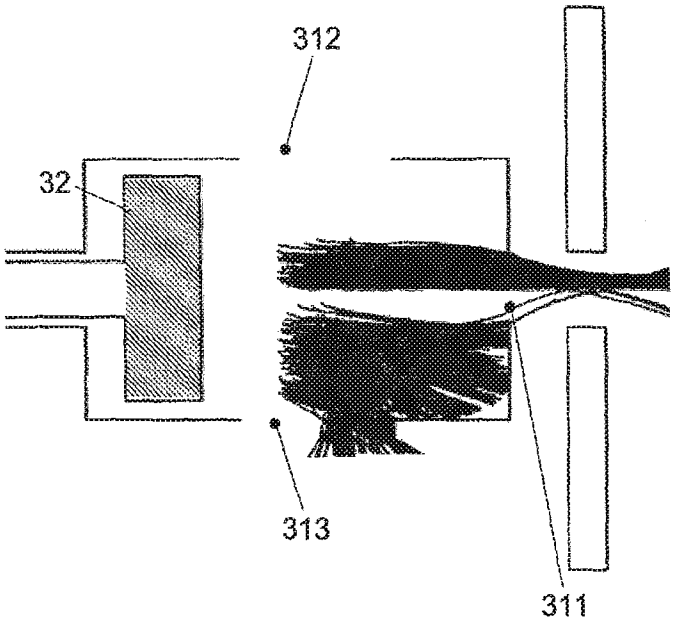
Figure 4A:
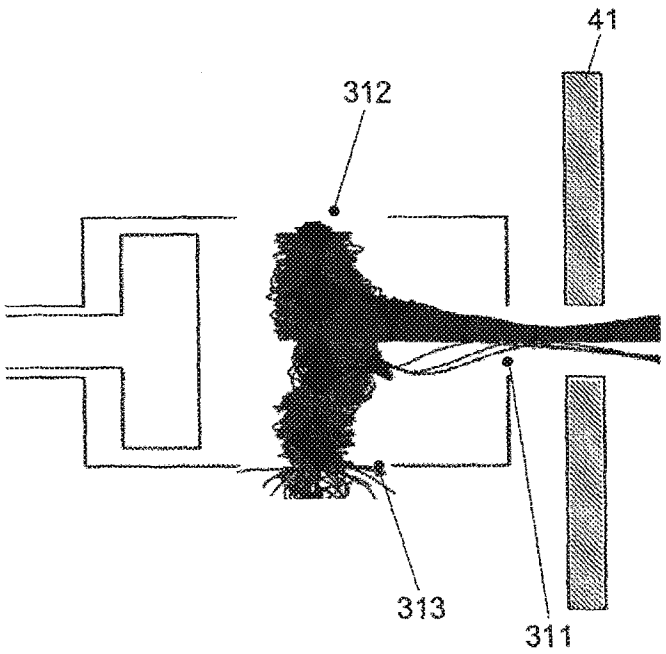
Figure 4B:
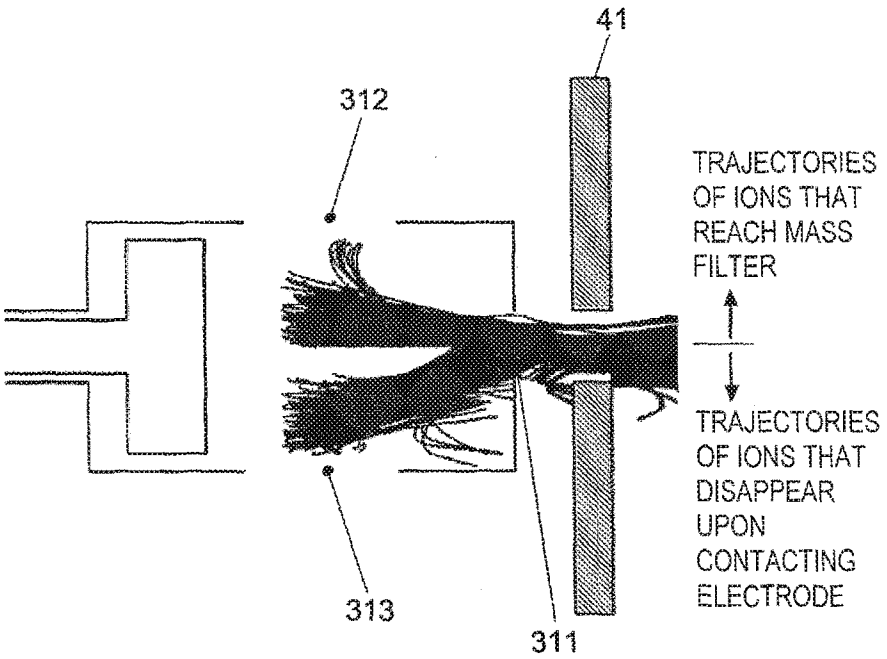
Figure 5A:
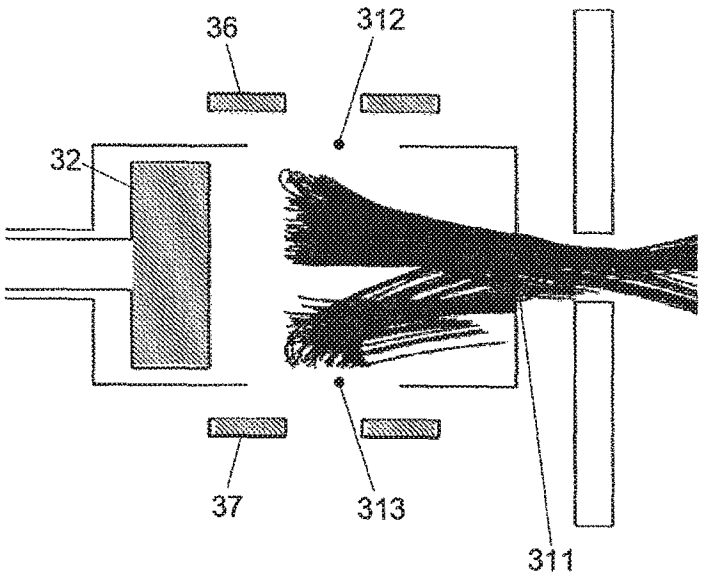
Figure 5B:
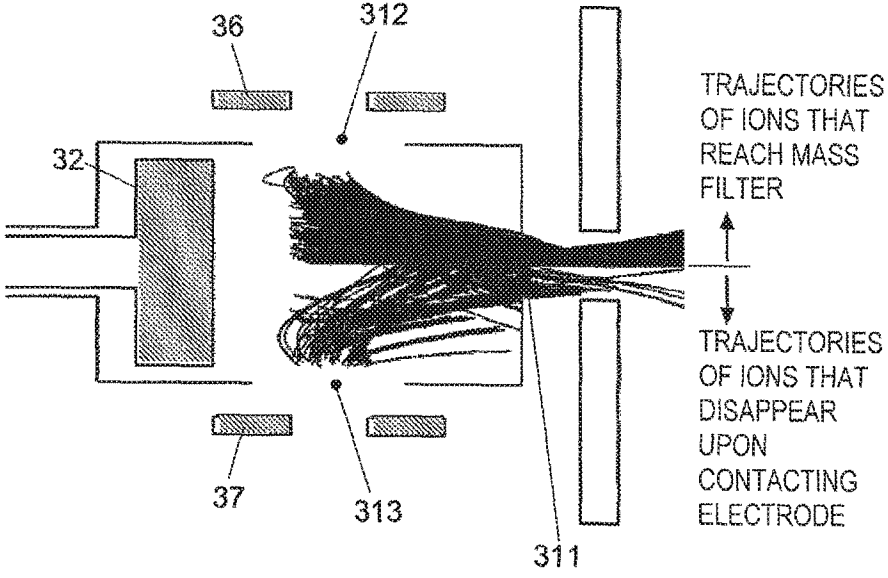

FIG. 3A to FIG. 5B each illustrate a calculation result of ion trajectories according to a computer simulation, in order to verify a difference in ion trajectories between the ion source 3 of the present embodiment and the conventional ion sources (the repelling mode and the extracting mode). FIG. 3A and FIG. 3B are diagrams each illustrating a simulation result of ion trajectories at the time of using the repeller electrode (repelling mode) in the conventional ion source, FIG. 4A and FIG. 4B are diagrams each illustrating a simulation result of ion trajectories at the time of using the extraction electrode (extracting mode) in the conventional ion source, and FIG. 5A and FIG. 5B are diagrams each illustrating a simulation result of ion trajectories in the ion source 3 of the present embodiment. FIG. 3A, FIG. 4A, and FIG. 5A each illustrate the case without a charge-up phenomenon, and FIG. 3B, FIG. 4B, and FIG. 5B each illustrate the case where a charge-up phenomenon occurs on the surface of the ionization chamber 31. Moreover, in FIG. 3A to FIG. 5B, constituent elements colored in solid black are constituent elements to which a positive DC voltage having the same polarity as that of the ions is applied. Further, in FIG. 3A to FIG. 5B, an upper half range illustrates the trajectories of ions that can reach the mass filter (not illustrated), and a lower half range illustrates the trajectories of ions that disappear by colliding against the electrode or the like on the way.

As illustrated in FIG. 3A and FIG. 3B, in the conventional repelling mode, only the ions produced around the center of the ionization chamber 31 are transported to the subsequent stage, and most of the ions produced at positions off the center disappear in the ionization chamber 31 or upon contacting the electrode. This is almost the same even in the state where the charge-up phenomenon occurs.

In comparison, as illustrated in FIG. 4A, in the conventional extracting mode, not only the ions produced around the center of the ionization chamber 31 but also the ions produced at positions significantly off the center are extracted from the inside of the ionization chamber 31 and are transported to the subsequent stage. However, even the ions existing around the center of the ionization chamber 31 partially disappear. This means that the electric field around the center of the ionization chamber 31 is relatively lower (the potential gradient is gentler) than that in the repelling mode. As a result, as illustrated in FIG. 4B, if the charge-up phenomenon occurs, the ion trajectories extremely change, and ions that are not transported to the subsequent stage increase. In other words, from the simulation results, it is easily presumed that the sensitivity of the extracting mode is higher when the charge-up phenomenon does not occur, but the sensitivity of the extracting mode more extremely decreases when the charge-up phenomenon occurs, compared with the repelling mode.

As is apparent by comparing FIG. 5A and FIG. 3A, in the ion source 3 of the present embodiment, even the ions at positions off the central part of the ionization chamber 31, most of which are not transported to the subsequent stage in the simple repelling mode, are led to the ion emission port 311 and transported to the subsequent stage, and few ions disappear upon contacting the inner wall surface of the ionization chamber 31. This is achieved by an effect that the electric field formed by the ion focusing electrodes 36 and 37 intrudes into the ionization chamber 31 and pushes the ions toward the central axis of the ion flow. Consequently, a large amount of ions can be transported to the subsequent stage, and high analysis sensitivity can be achieved.

As illustrated in FIG. 5B, the ion trajectories in the ion source 3 of the present embodiment are almost the same even in the state where the charge-up phenomenon occurs. This means that both the ion repelling action of the repelling electric field and the ion focusing action of the focusing electric field are hardly influenced by the charge-up phenomenon. From this fact, it can be understood that high analysis sensitivity can be maintained even if the charge-up phenomenon occurs along with long-term use of the apparatus.

As described above, from the simulation results of the ion trajectories, it can be verified that both high sensitivity and high stability of the sensitivity can be achieved in the ion source 3 of the present embodiment.

The trajectories of the thermal electrons produced from the filament 34 are also obtained together with the simulations of the ion trajectories. As a result, because the acceleration of the thermal electrons is high, it is verified that the trajectories of the thermal electrons are hardly influenced if the voltage Vs applied to each of the ion focusing electrodes 36 and 37 is within the above-mentioned range.

In the above-mentioned embodiment, the ion focusing electrodes 36 and 37 are respectively provided on the outer sides of the electron introduction port 312 and the electron discharge port 313, and this is desirable in terms of an ion focusing effect. Alternatively, the ion focusing electrode may be provided on the outer side of only any one of the two ports. Moreover, although different voltages can be applied to the two ion focusing electrodes 36 and 37, it is sufficient to apply the same voltage to the two electrodes in a normal operation.

Although the ion source of the above-mentioned embodiment is an EI ion source, the present invention can also be applied to a CI ion source. Moreover, not limited to the ion source of the mass spectrometer, the present invention can also be used as ion sources of other apparatuses using ions such as an ion implantation apparatus.

The above-mentioned embodiment is merely an example of the present invention, and it is obvious that any adjustments, changes, and additions to be made appropriately within the gist of the present invention, as well as the above-mentioned modifications, are embraced in the scope of the claims of the present application.

REFERENCE SIGNS LIST

1 . . . Chamber
2 . . . Vacuum Pump
3 . . . Ion Source
31 . . . Ionization Chamber
311 . . . Ion Emission Port
312 . . . Electron Introduction Port
313 . . . Electron Discharge Port
314 . . . Sample Introduction Port
32 . . . Repeller Electrode
34 . . . Filament
35 . . . Counter Filament (Trap Electrode)
341, 351 . . . Filament Chamber
36, 37 . . . Ion Focusing Electrode

38 . . . Magnet
4 . . . Ion Transport Optical System
41 . . . Extraction Electrode
5 . . . Quadrupole Mass Filter
6 . . . Ion Detector
71 . . . First Ion Focusing Voltage Source
72 . . . Second Ion Focusing Voltage Source
73 . . . Repeller Voltage Source

The invention claimed is:

1. An ionization apparatus for ionizing predetermined sample molecules or atoms, the ionization apparatus comprising:

a) an ionization chamber having: an electron introduction port for introducing thermal electrons to an internal space of the ionization chamber; an electron discharge port for discharging thermal electrons that have passed through the internal space; and an ion emission port for emitting sample-derived ions produced in the internal space to an outside;

b) a thermal electron source for producing the thermal electrons, the thermal electron source being arranged on an outer side of the electron introduction port;

c) an electron trapping unit for trapping the thermal electrons discharged through the electron discharge port, the electron trapping unit being arranged on an outer side of the electron discharge port;

d) a repeller electrode for forming, in the ionization chamber, a repelling electric field that repels the sample-derived ions produced in the ionization chamber toward the ion emission port, the repeller electrode being arranged inside of the ionization chamber so as to be opposed to the ion emission port; and e) an ion focusing electrode for forming, in the ionization chamber, a focusing electric field that focuses the sample-derived ions produced in the ionization chamber around a central axis of an ion flow formed by repelling the sample-derived ions by the repelling electric field, the ion focusing electrode being arranged any one or both of between the thermal electron source and the electron introduction port and between the electron discharge port and the electron trapping unit.

2. The ionization apparatus according to claim 1, wherein the ion emission port is provided to the ionization chamber such that the ions are emitted in a direction substantially orthogonal to a direction in which the thermal electrons are introduced into the ionization chamber through the electron introduction port.

3. The ionization apparatus according to claim 2, further comprising a voltage applying unit for applying a DC voltage Vr having a same polarity as that of the sample-derived ions, to the repeller electrode and for applying a DC voltage Vs having a same polarity as that of the sample-derived ions, to the ion focusing electrode, wherein the DC voltage Vr is 1 and 20 [V], and the DC voltage Vs is 5 and 50 [V].

4. The ionization apparatus according to claim 1, further comprising a voltage applying unit for applying a DC voltage Vr having a same polarity as that of the sample-derived ions, to the repeller electrode and for applying a DC voltage Vs having a same polarity as that of the sample-derived ions, to the ion focusing electrode, wherein the DC voltage Vr is 1 and 20 [V], and the DC voltage Vs is 5 and 50 [V].

* * * * *